US007475844B2

(12) United States Patent
Kuwabara

(10) Patent No.: US 7,475,844 B2
(45) Date of Patent: Jan. 13, 2009

(54) WEB WINDING DEVICE AND SPACER

(75) Inventor: Fujio Kuwabara, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/884,769

(22) PCT Filed: Mar. 17, 2006

(86) PCT No.: PCT/JP2006/305384

§ 371 (c)(1),
(2), (4) Date: Aug. 21, 2007

(87) PCT Pub. No.: WO2006/101043

PCT Pub. Date: Sep. 28, 2006

(65) Prior Publication Data

US 2008/0149756 A1 Jun. 26, 2008

(30) Foreign Application Priority Data

Mar. 22, 2005 (JP) ..... 2005-082627

(51) Int. Cl.
*B65H 18/08* (2006.01)

(52) U.S. Cl. ..... 242/530.1; 242/530.3

(58) Field of Classification Search ..... 242/530, 242/530.1, 530.3–530.4
See application file for complete search history.

(56) References Cited

U.S. PATENT DOCUMENTS

| | | | | |
|---|---|---|---|---|
| 3,547,332 | A * | 12/1970 | Gaudin | 226/195 |
| 3,669,369 | A * | 6/1972 | Emich | 242/530.3 |
| 4,026,488 | A * | 5/1977 | Hashimoto | 242/571.2 |
| 4,093,140 | A * | 6/1978 | Matsunaga | 242/530.1 |
| 4,438,888 | A * | 3/1984 | Seelinger | 242/530.3 |
| 4,693,431 | A * | 9/1987 | Kataoka | 242/413.1 |
| 5,137,224 | A * | 8/1992 | Peters et al. | 242/530.3 |
| 2002/0084375 | A1 * | 7/2002 | Watanabe et al. | 242/413.2 |
| 2005/0139716 | A1 * | 6/2005 | Kuwabara et al. | 242/530.1 |

FOREIGN PATENT DOCUMENTS

| | | | |
|---|---|---|---|
| JP | 62-51538 | A | 3/1987 |
| JP | 8-104452 | A | 4/1996 |
| JP | 2000-16642 | A | 1/2000 |
| JP | 2000-318889 | A | 11/2000 |

* cited by examiner

*Primary Examiner*—Sang Kim
(74) *Attorney, Agent, or Firm*—Sughrue Mion, PLLC

(57) ABSTRACT

A web winding device (not shown) is disposed in a downstream side from a slitter (not shown) in a web transporting direction. Spacers 34 for positioning and winding cores 33 are mounted alternately to a first winding shaft 26 of the web winding device. Each spacer 34 includes a spacer body 57 being in contact with a peripheral surface of the first winding shaft 26 and contact members 58 being in contact with the winding cores 33 on both sides of the spacer body 57. The contact member 58 is held by a contact member holding recess 59 provided in the spacer body 57. A plurality of resin rollers 62 are disposed between the contact member 58 and the contact member holding recess 59. Thereby, the contact member 58 is rotatably held relative to the spacer body 57. Since each winding core 33 can be rotated independently, it is possible to wind webs at a stable winding tension.

8 Claims, 6 Drawing Sheets

WEB WINDING DEVICE AND SPACER

TECHNICAL FIELD

The present invention relates to a web winding device for simultaneously winding a plurality of webs around a plurality of winding cores respectively mounted on a winding shaft, and a spacer mounted to the winding shaft.

BACKGROUND ART

In a production line of a photosensitive film, a magnetic tape, or the like, a broad raw material web such as paper or film is subjected to various kinds of treatment including coating treatment and drying treatment using a photosensitive material and a magnetic material, and then the raw material web is wound in a roll shape (raw material web coil). The raw material web coil is set to a web cutting device. In the web cutting device, first of all, the raw material web drawn from the raw material web coil is cut into a plurality of narrow webs by a slitter. Next, the plurality of narrow webs thus cut are simultaneously wound in a roll shape by a web winding device disposed in a downstream side from the slitter in a web transporting direction, thus a product web coil is obtained.

Two winding shafts are generally disposed in the web winding device. The plurality of narrow webs cut by the slitter are simultaneously wound around after being allocated alternately to each other of the two winding shafts such that the side ends of the narrow webs are not overlapped with each other during winding of the webs. A plurality of winding cores for winding the respective narrow webs and a plurality of approximately cylindrical spacers are mounted to each of the winding shafts so as to be arranged in a line alternately. The spacer defines a position of each of the winding cores such that each winding core corresponds to a position of each allocated narrow web (see Patent Document 1).

Upon finishing the winding of the narrow web, the winding core around which the narrow web is wound is removed from the winding shaft, and a new winding core is set to the winding shaft. Accordingly, in general, the winding cores and the spacers are detachably attached to the winding shaft so as to be removed easily from the winding shaft. Therefore, a stopper for regulating the moving of the winding cores and the spacers in the axial direction is provided at one end of the winding shaft, and the winding cores and the spacers are biased toward the stopper by a predetermined biasing force. Thereby, the spacers abut on both side surfaces of each winding core, and the position of the winding core in the axial direction is defined. Further, chuck claws or the like to be in pressure contact with an inner peripheral surface of the winding core are disposed at the winding shaft. When both winding shafts are rotated, the chuck claw and the inner peripheral surface of the winding core are in sliding contact with each other, and rotational force of the winding shafts is transmitted to the winding core. When the narrow web is wound, the winding core is rotated at a peripheral velocity corresponding to the transporting speed of the web. Therefore, when the winding shaft is rotated faster than the winding core, there occurs sliding between the winding shaft and the winding core due to the rotational difference, and then winding tension in accordance with the sliding coefficient of friction thereof is generated (see Patent Documents 2 and 3).

Reference 1: Japanese Patent Laid-open Publication Number 8-104452 (P.2, FIG. 3)

Reference 2: Japanese Patent Laid-open Publication Number 2000-318889 (P.2 to 3, FIG. 1)

Reference 3: Japanese Patent Laid-open Publication Number 2000-16642 (P.2 to 3, FIG. 1)

DISCLOSURE OF INVENTION

Problems to be Solved by the Invention

There is thickness variation in a width direction of the raw material web. Therefore, when the narrow web is wound around each winding core mounted to the winding shaft, there arises a difference in winding diameter between the respective product web coils. When the winding diameter of a product coil is larger than an adjacent product coil rotated at the same rotational speed, a peripheral velocity W1 of one product web coil having a larger winding diameter becomes faster than a peripheral velocity W2 of the other product web coil. At this time, each winding core is rotated while being in sliding contact with the winding shaft (chuck claw) as described above. Therefore, there occurs further sliding between the winding core and the winding shaft of the product web coil having a larger diameter. The peripheral velocity W1 is decreased to a level of the peripheral velocity W2.

However, the spacer abuts on both side surfaces of the respective winding cores as described above. The spacer is rotated at the same speed as that of the winding shaft since the spacer is in contact with the winding shaft by its weight. Accordingly, torque in a rotational direction of the winding shaft from the spacer is applied to the winding core abutting on the spacer in accordance with contact resistance therebetween and the rotational speed of the spacer. The torque prevents the decelerating of the peripheral velocity W1. Since the torque is varied, the winding tension on the narrow web becomes unstable.

Further, when the biasing force for biasing the winding core and the spacer toward the stopper is strong, there occurs no sliding between the winding core and the spacer, and therefore the winding cores sandwiching the spacer are substantially connected to each other. Therefore, the product web coils having a winding diameter different from each other are rotated at the same rotational speed. Accordingly, depending on the winding diameter, the peripheral velocity of each product web coil will be faster or slower than the appropriate velocity. As a result, the tightly wound product web coil due to the increase in the winding tension and the loosely wound product web coil due to the decrease in the winding tension are formed.

An object of the present invention is to provide a web winding device capable of winding webs around each winding core positioned in a winding shaft by a spacer with a stable winding tension, and a spacer used therefor.

Means for Solving the Problems

To achieve the above object, a web winding device of the present invention includes a winding shaft extending along a width direction of a web, a plurality of winding cores arranged in a line in an axial direction of the winding shaft so as to be rotatable around the winding shaft, a rotation transmission member provided at the winding shaft and being in sliding contact with an inner peripheral surface of the winding core at the time of rotating the winding shaft, and a plurality of spacers mounted to the winding shaft so as to be alternate with a plurality of the winding cores, for positioning each winding core in the axial direction. The spacer includes an approximately cylindrical spacer body abutting on the winding shaft, a contact member protruding from a spacer body side surface opposed to the winding core and abutting on the winding core, and a holding member for holding the contact member rotatably around the spacer body.

It is preferable that the contact member has an annular shape with its center at a rotational axis line of the winding shaft, and held by the holding member so as to be rotatable around the rotational axis line relative to the spacer body. Further, the holding member preferably includes an approximately annular holding recess formed on the spacer body side surface opposed to the winding core with its center at the rotational axis line, and a plurality of rollers disposed between a bottom surface of the holding recess and the contact member.

Preferably, the spacer body, the contact member, and the rollers are made from any of one of resin, MC material, and MC nylon material. Further, it is preferable that a plurality of the winding shafts are disposed in the web winding device, and a plurality of the webs are allocated to the respective winding shafts and wound around the winding core mounted to each of the winding shaft.

A spacer of the present invention is mounted to a winding shaft so as to be alternate with each of a plurality of winding cores, and defines a position of the winding core mounted to the winding shaft in an axial direction of the winding shaft. The spacer includes an approximately cylindrical spacer body abutting on the winding shaft, a contact member protruding from a spacer body side surface opposed to the winding core and abutting on the winding core, the contact member having an approximately annular shape with its center at a rotational axis line of the winding shaft, a holding recess formed on the spacer body side surface opposed to the winding core and having an approximately annular shape with its center at the rotational axis line, for holding the contact member rotatably around the rotational axis line of the winding shaft, and a plurality of rollers disposed between a bottom surface of the holding recess and the contact member.

Preferably, the spacer body, the contact member, and the rollers are made from any of one of resin, MC material, and MC nylon material.

EFFECT OF THE INVENTION

The web winding device of the present invention includes a winding shaft extending along a width direction of a web, a plurality of winding cores arranged in a line in an axial direction of the winding shaft so as to be rotatable around the winding shaft, a rotation transmission member provided at the winding shaft and being in sliding contact with the inner peripheral surfaces of the winding cores at the time of rotating the winding shaft, and a plurality of spacers mounted to the winding shaft so as to be alternate with a plurality of the winding cores, for positioning each winding core in the axial direction. Further, the spacer includes an approximately cylindrical spacer body abutting on the winding shaft, a contact member protruding from a spacer body side surface opposed to the winding core and abutting on the winding core, and a holding member for holding the contact member rotatably around the spacer body. Accordingly, each of the winding cores on the winding shaft can be rotated independently from each other without being affected by the spacers, and the winding tension of each winding core for the web can be stabilized within the predetermined range. As a result, it is possible to stabilize the winding shape and winding hardness of the wound web coil.

Further, the contact member has an annular shape with its center at a rotational axis line of the winding shaft, and is held by the holding member so as to be rotatable around the rotational axis line relative to the spacer body. Accordingly, it is possible to efficiently prevent the transmission of torque to the winding core from the spacer rotated around the rotational axis line of the winding shaft.

The holding member includes an approximately annular holding recess formed on the spacer body side surface opposed to the winding core with its center at the rotational axis line, and a plurality of rollers disposed between a bottom surface of the holding recess and the contact member. Accordingly, it is possible to efficiently prevent the transmission of torque from the spacer to the winding core.

The spacer body, the contact member, and the rollers are made from any of one of resin, MC material, and MC nylon material. Accordingly, it is possible to reduce the weight of the web winding device.

A plurality of the winding shafts are disposed in the web winding device, and a plurality of the webs are allocated to each of the winding shafts and wound around the winding core mounted to each of the winding shafts. Accordingly, it is possible to prevent the side ends of the webs adjacent from touching/overlapping with each other.

Moreover, the spacer of the present invention is mounted to a winding shaft so as to be alternate with each of a plurality of winding cores and defines a position of each winding core mounted to the winding shaft in a direction of the winding shaft. The spacer includes an approximately cylindrical spacer body abutting on the winding shaft, a contact member protruding from the spacer body side surface opposed to the winding core and abutting on the winding core, the contact member having an approximately annular shape with its center at a rotational axis line of the winding shaft, a holding recess formed on the spacer body side surface opposed to the winding core and having an approximately annular shape with its center at the rotational axis line, for holding the contact member rotatably around the rotational axis line of the winding shaft, and a plurality of rollers disposed between a bottom surface of the holding recess and the contact member. Therefore, in a similar manner, each of the winding cores on the winding shaft can be rotated independently from each other without being affected by the spacers, and the winding tension on each winding core for the web can be stabilized within the predetermined range.

The spacer body, the contact member, and the rollers are made from any of one of resin, MC material, and MC nylon material. Accordingly, it is possible to reduce the weight of the spacer.

DESCRIPTION OF REFERENCE NUMERALS

Figure 1:
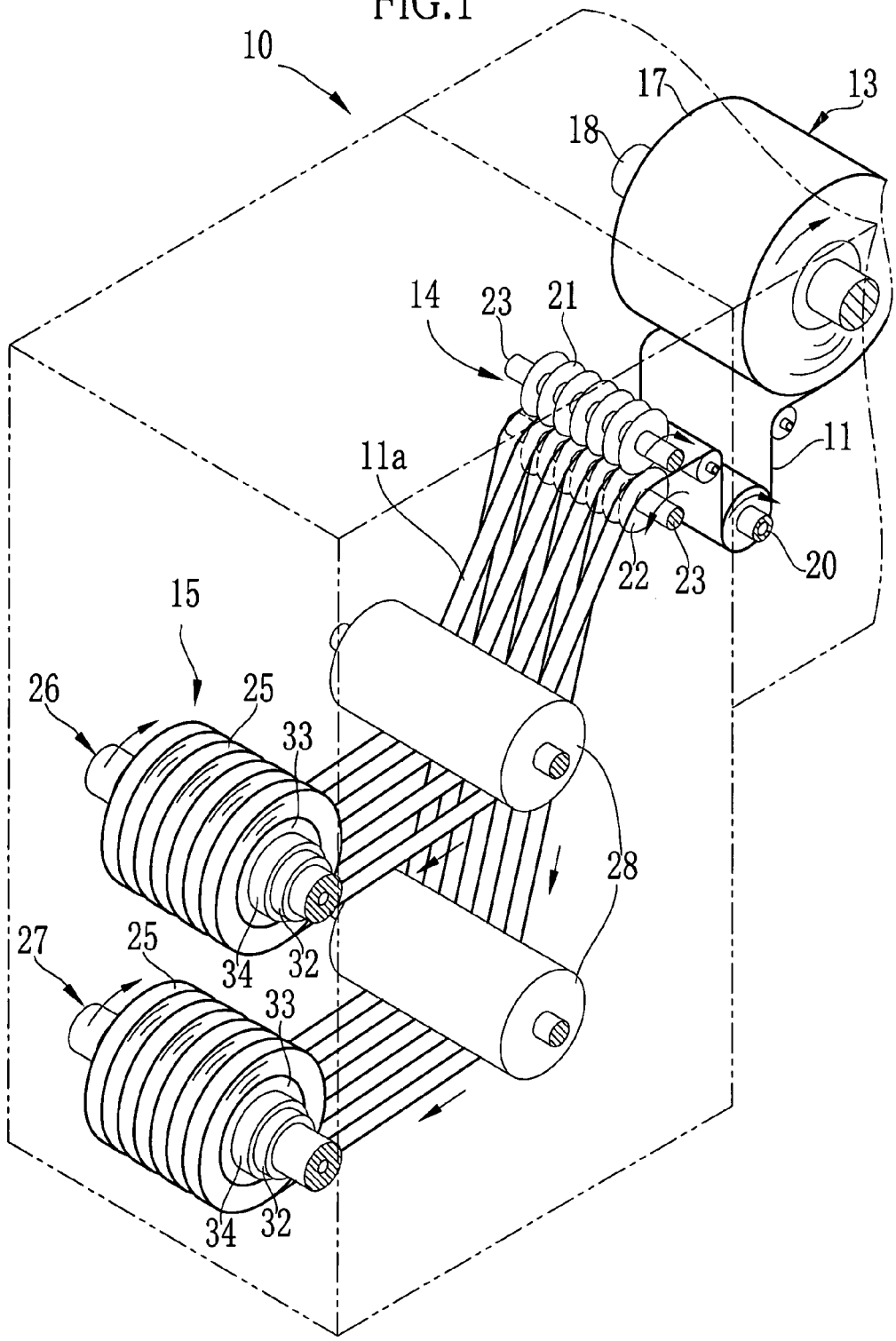
[FIG. 1] A schematic view of a web cutting device including a web winding device according to an embodiment of the prevent invention.

10 web cutting device
11*a* product web
14 slitter
15 web winding device
25 web coil
26 first winding shaft
27 second winding shaft
33 winding core
34 spacer
43 chuck claw
57 spacer body
58 contact member
62 resin roller

DESCRIPTION OF THE PREFERRED EMBODIMENTS

As shown in FIG. 1, a web cutting device 10 cuts a wide raw material web 11 into a plurality of product webs 11*a* each having a predetermined narrow width. Note that the raw material web 11 is preliminarily subjected to a coating treatment and drying treatment using a photosensitive material, a magnetic material, and the like. The web cutting device 10 is mainly composed of a raw material web supplying device 13, a slitter (a cutting device) 14, and a web winding device 15.

The raw material web supplying device 13 includes a coil rotational shaft 18, a holder (not shown), and a motor (not shown). A raw material web coil 17 obtained by winding the raw material web 11 in a roll shape is set to the coil rotational shaft 18. The holder holds the coil rotational shaft 18 rotatably. The motor is connected to the coil rotational shaft 18. When the coil rotational shaft 18 is rotated by the motor clockwise in the drawing, the raw material web 11 is drawn from the raw material web coil 17. The drawn raw material web 11 is transported to a slitter 14 by a suction drum 20 disposed in a downstream side from the raw material web coil 17 in a transporting direction of the web.

The slitter 14 includes a plurality of upper rotatable cutting blades 21 and lower rotatable cutting blades 22, slitter shafts 23, holders (not shown), and a motor for rotating cutting blades (not shown). The upper rotatable cutting blades 21 and lower rotatable cutting blades 22 are disposed so as to sandwich the raw material web 11 continuously transported from the raw material web coil 17. The upper rotatable cutting blades 21 and lower rotatable cutting blades 22 are fixed to the slitter shafts 23. The holder holds the both slitter shafts 23 rotatably. The motor for rotating cutting blade is connected to the both slitter shafts 23.

The rotatable cutting blades 21, 22 are fixed to the slitter shaft 23 at an interval which is equal to a width of the product web 11*a* by respective spacers not shown in the drawing. When the raw material web 11 is transported between the upper rotatable cutting blades 21 and the lower rotatable cutting blades 22 from the raw material web coil 17, the upper rotatable cutting blades 21 rotate clockwise and the lower rotatable cutting blades 22 rotate counterclockwise direction in the drawing. Thereby, the raw material film 11 is cut into a plurality of product webs 11*a*. The product webs 11*a* thus cut are continuously transported to the web winding device 15.

The web winding device 15 simultaneously winds the plurality of product webs 11*a* into a coil shape to form the product web coils (hereinafter referred to as web coils) 25. The web winding device 15 includes a first winding shaft 26 and a second winding shaft 27 disposed below the first winding shaft 26 in the vertical direction. The product webs 11*a* cut by the slitter 14 are allocated, one by one, to the first winding shaft 26 and the second winding shaft 27 in an alternate manner with use of guide rollers 28 and transporting guides not shown in the drawing. For example, when reference numerals 1, 2, 3, . . . , and N are given in this order to the product webs 11 from the right side in the drawing in this embodiment, the product webs 11*a* having odd reference numbers are allocated to the first winding shaft 26, and the product webs 11*a* having even reference numbers are allocated to the second winding shaft 27. Thereby, it is possible to prevent the side ends of the adjacent product webs 11*a* from touching/overlapping with each other at the time of winding the webs.

Figure 2:
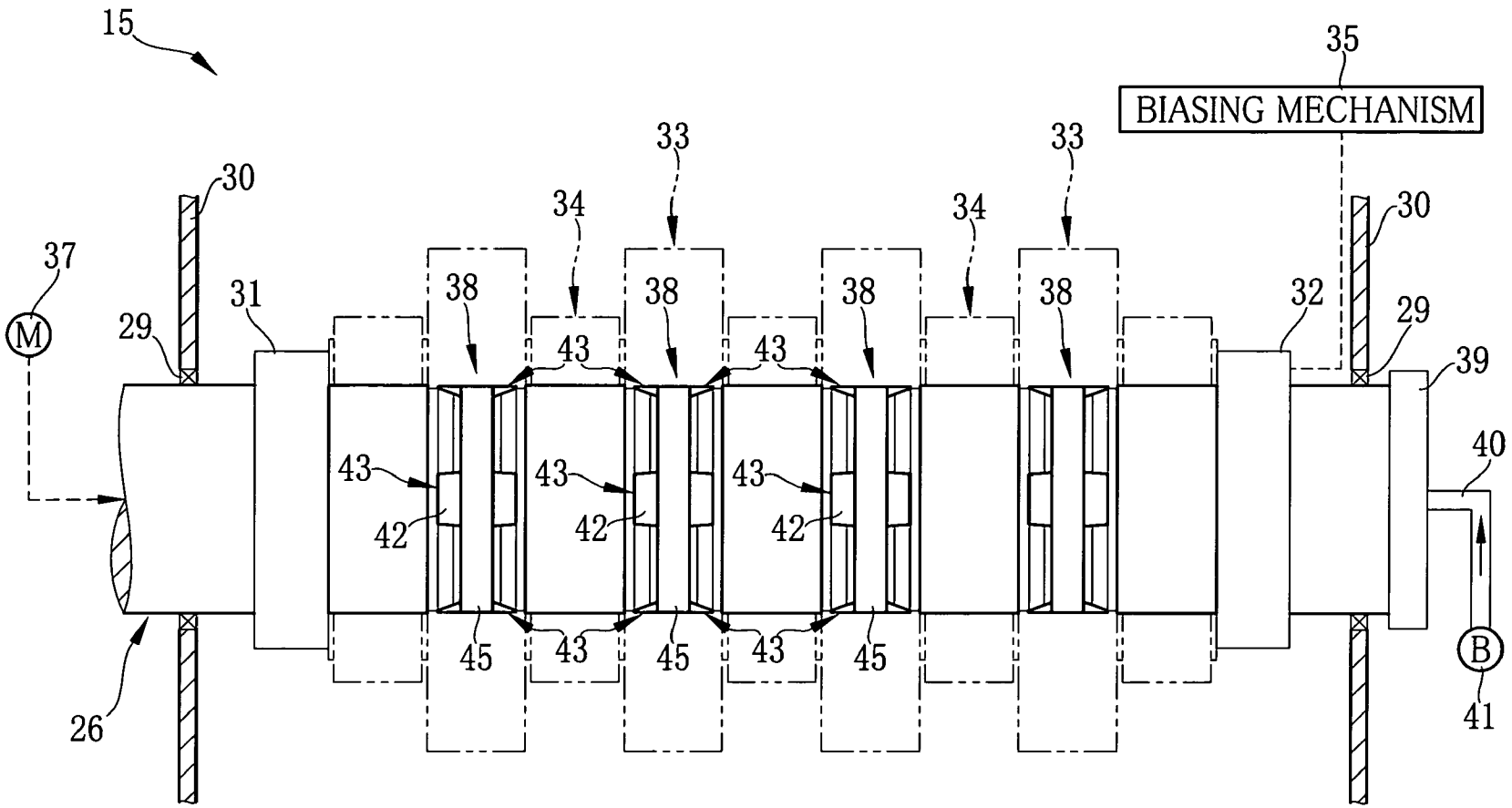
[FIG. 2] An external view of a winding shaft of the web winding device.

As shown in FIG. 2, the first shaft 26 is rotatably held by side walls 30 of a device body through bearing 29. The second winding shaft 27 has the same structure as the first winding shaft 26, and therefore the detailed description about the second winding shaft 27 will be omitted. A plurality of winding cores 33 for winding the product webs 11*a* and approximately cylindrical spacers 34 are alternately and rotatably provided between a fixed collar 31 fixed at one side of the first winding shaft 26 and a movable collar 32 mounted to the other side of the first winding shaft 26 so as to be movable in the axial direction.

The movable collar 32 is biased toward the fixed collar 31 by a biasing device 35 (including a cylinder, a rod, a swing arm, and the like). Thereby, the winding cores 33 and the spacers 34 are arranged so as to be adjacent to each other without clearance in the axial direction of the first winding shaft 26.

The spacer 34 abuts on both side surfaces of each winding core 33 to define the position of each winding core 33 in the axial direction. The length of the spacer 34 is equal to the width of the product web 11*a*. Accordingly, it is only required to adjust the mounting position of the fixed collar 31 in order to position the winding cores 33 in accordance with the position of the allocated product webs 11*a*. Note that the spacer 34 is described in detail later.

A motor 37 is connected to one end of the first winding shaft 26 through a driving connection mechanism not shown in the drawing. The motor 37 rotates the first winding shaft 26 at the time of winding the product web 11*a*. In this embodiment, each of the winding cores 33 is attached to the first winding shaft 26 in a rotatable and slidable manner so that a web coil 25 can be removed together with the winding core 33. Therefore, the first winding shaft 26 is provided with a rotation transmission mechanism 38 for transmitting rotational force of each shaft to the winding core 33. An air joint 39 is movably attached to the other end of the first winding shaft 26. An air blower 41 is connected to the first winding shaft 26 through the air joint 39 and an air pipe 40.

Figure 5:
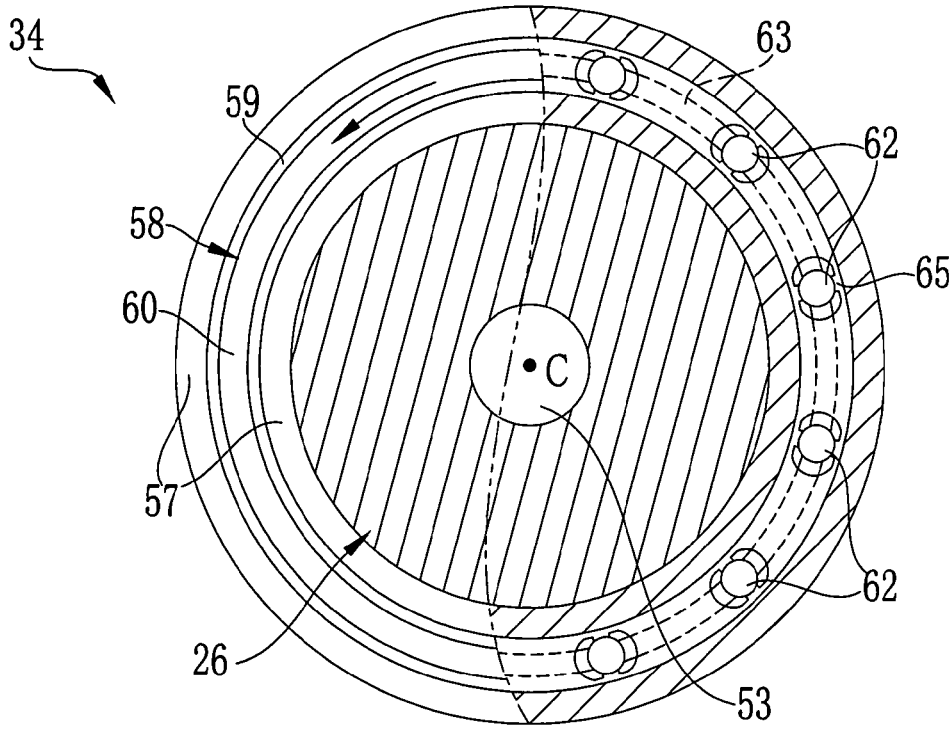
[FIG. 5] A front view of the spacer viewed in an axial direction of the winding shaft.

As shown in FIG. 2, the rotation transmission mechanism 38 includes chuck claws 43, a claw holding member 45, and a claw transporting mechanism (not shown). Four pairs of the chuck claws 43 are disposed along a peripheral direction of the first winding shaft 26 at the same interval, and each of the chuck claws 43 has a pressing surface 42 to be in pressure contact with the inner peripheral surface of the winding core 33. The claw holding member 45 has an annular shape, and holds each of the chuck claws 43 slidably in a direction perpendicular to the axial direction of the first winding shaft 26. The claw transporting mechanism slides each chuck claw 43 held by the annular claw holding member 45 and the claw holding member 45 between a pressurized position and a retreated position. In the pressurized position, each chuck claw 43 is in pressure contact with the inner peripheral surface of the winding core 33. In the retreated position, each chuck claw 43 is retreated from the pressurized position. The claw transporting mechanism includes a cylinder, a rod, and the like, and is connected to the air blower 41 through an air passage 53 formed inside the first winding shaft 26 (see FIG. 5), the air joint 39, and the air pipe 40. The claw transporting mechanism (not shown) pressurizes each chuck claw 43 such that the pressing surface 42 is in pressure contact with the inner peripheral surface of the winding core 33 when the air blower 41 supplies air thereto. Note that a mechanism for pressurizing the chuck claw 43 against the inner peripheral surface of the winding core 33 is not especially limited, and various mechanisms may be adopted.

When the first shaft 26 is rotated in a state where the chuck claw 43 is in pressure contact with the inner peripheral surface of the winding core 33, the pressing surface 42 of the chuck claw 43 and the inner peripheral surface of the winding core 33 is in sliding contact with each other. Thereby, the rotation of the shaft is transmitted to the winding core 33. As described above, the winding core 33 is rotated at the peripheral velocity corresponding to a transporting speed of the product web 11*a* when winding the product web 11*a*. Accordingly, when the first winding shaft 26 is rotated faster than the winding core 33, slipping occurs between the first winding shaft 26 and the winding core 33 due to a rotational speed difference, thus causing a winding tension in accordance with the sliding coefficient of friction thereof. At the end of winding, the air supply from the air blower 41 to the claw transporting mechanism is stopped to interrupt the pressurization of the chuck claw 43. Thereby, it becomes possible to remove the winding cores 33 from the winding shafts 26 and 27. When the winding core 33 is to be removed from the first winding shaft 26, the air joint 39 and the side wall 30 in the right side of FIG. 2 are removed from the first winding shaft 26.

Figure 3:
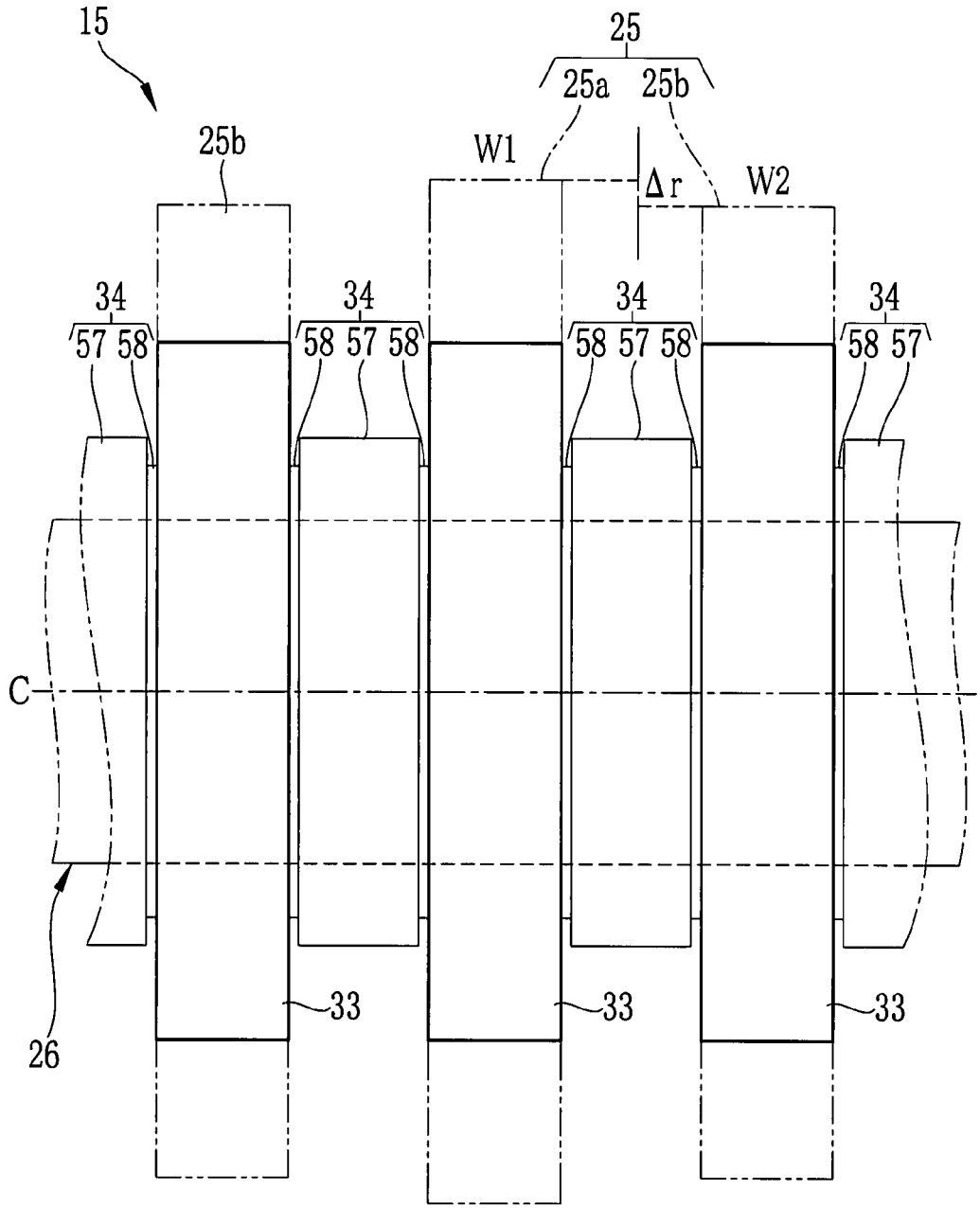
[FIG. 3] A side view of spacers mounted to the winding shaft.

As described above, the thicknesses of the product webs 11*a* wound around the winding core 33 are not always equal to each other. Therefore, as shown in FIG. 3, there is a difference in the winding diameter between the web coils 25 wound around the winding core 33. Note that a reference numeral 25*a* denotes the web coil 25 which has a winding diameter larger than the adjacent web coil 25 denoted by a reference numeral 25*b* in FIG. 3. A difference $\Delta r$ in winding diameter between the web coils 25*a* and 25*b* in the drawing is shown in an emphasized state in comparison with the real difference. Accordingly, when both web coils 25*a* and 25*b* are rotated at the same rotational speed, a peripheral velocity W1 of the web coil 25*a* is faster than a peripheral velocity W2 of the web coil 25*b*. As describe above, the winding core 33 of the web coil 25 is rotated while being in sliding contact with the chuck claw 43 (the first winding shaft 26). Accordingly, sliding further occurs between the winding core 33 of the web coil 25*a* and the first winding shaft 26. Thereby, the peripheral velocity W1 of the web coil 25*a* decreases to a level of the peripheral velocity W2 of the web coil 25*b*.

At this time, the spacers 34 abutting on both surfaces of the winding cores 33 of the web coils 25*a* and 25*b* rotate at the approximately same speed as the first winding shaft 26, that is, at the speed faster than that of the winding core 33. Therefore, as described above, torque in the rotational direction of the winding shaft is applied to the winding core 33 of the web coil 25*a* by the spacer 34, and thereby the peripheral velocity W1 of the web coils 25*a* is prevented from decreasing. Since the torque is varied in accordance with the frictional resistance between the spacer 34 and the winding core 33 and the rotational speed of the spacer 34, the winding tension of each web coil 25 for the product web 11*a* becomes unstable. Further, in a case where biasing force for biasing the winding core 33 and the spacer 34 toward the fixed collar 31 is strong, the web coils 25*a* and 25*b* are rotated at the same rotational speed. Therefore, the peripheral velocity of the web coil 25*a* having a larger winding diameter is faster than its appropriate speed, and the peripheral velocity of the web coil 25*b* having a smaller winding diameter is slower than its appropriate speed. As a result, the tightly wound web coil 25*a* due to the increase in the winding tension and the loosely wound web coil 25*b* due to the decrease in the winding tension will be formed.

Figure 4:
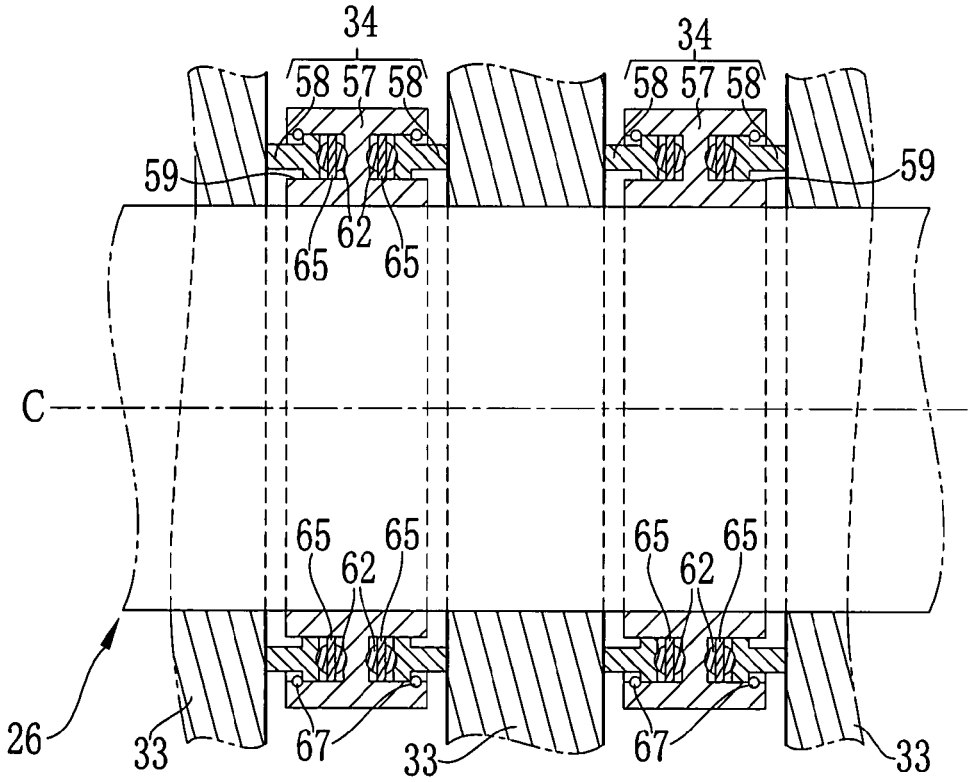
[FIG. 4] A sectional view of the spacers.

In view of the above, in this embodiment, in order to stabilize the winding tension on the product web 11*a* on each winding core 33, the shape of the spacer 34 is a thrust bearing. Thereby, it is possible to prevent transmission of the torque from the spacer 34 to the winding core 33, and rotate each winding core 33 independently. Hereinafter, the spacer 34 of the present invention is described by referring to FIGS. 3 to 5. Note that chuck claws 43 and the like described above are not shown for the purpose of preventing complication of the drawings in FIGS. 3 to 5.

The spacer 34 is mainly composed of an approximately cylindrical spacer body 57 being in contact with the first winding shaft 26, and approximately annular contact members 58 protruding from both side surfaces of the spacer body 57 and abutting on the side surfaces of the winding cores 33 adjacent to the spacer 34, that is, three members in total. The spacer body 57 is made from resin, MC material (metal ceramics composite material), MC (monomer cast) nylon material, or the like for reducing the weight of the first winding shaft 26. The spacer body 57 holds the contact members 58 rotatably relative to the rotating center line C of the first winding shaft 26. Therefore, an approximately annular contact member holding recess 59 is formed to rotatably hold the contact members 58 on both side surfaces of the spacer 57.

The contact member 58 is also made from resin, MC material, MC nylon material, or the like for reducing the weight of the first winding shaft 26. The contact member 58 has a contacting surface 60 (see FIG. 5) abutting on a side surface of the winding core 33. The contacting surface 60 protrudes from the side surface of the spacer body 57 by approximately 1 mm, for example. In the above manner, the spacer 34 is divided into three sections including the spacer body 57 being in contact with the peripheral surface of the first winding shaft 26 and contact members 58 abutting on each surface of the winding cores 33 adjacent to the spacer body 57. Therefore, no member is in contact with both the peripheral surface of the first winding shaft 26 and the side surface of the winding core 33.

A plurality of spherical resin rollers (ball bearings) 62 are disposed at the same interval between the contact member 58 and a bottom surface of the contact member holding recess 59. Note that, although the resin rollers 62 are used for lightening of the first winding shaft 26 in this embodiment, the present invention is not limited thereto, and the rollers made from MC material or MC nylon material also may be used.

The respective resin rollers 62 are rotatably held by retainers 65 and abut on guide recesses 63 respectively formed on the bottom surface of the contact member holding recess 59 and the contact member 58. The retainer 65 includes rotational shafts/rods provided so as to be parallel to a radial direction of the first winding shafts 26, 27 at the same interval. The resin rollers 62 are rotated around the respective rotational shafts/rods. Here, the radial direction is a direction perpendicular to the rotational center line C. Additionally, a stopper 67 (see FIG. 4) is provided along an opening of the contact member holding recess 59 for the purpose of preventing the contact member 58 from dropping off from the spacer body 57.

With the above structure, even when one of the spacer body 57 and the contact member 58 is rotated, each of the resin rollers 62 is rotated along the guide recesses 63 and 64, respectively, and therefore only slightly torque caused by the rotation of the resin roller 62 is applied to the other one. Accordingly, even when the biasing mechanism 35 biases the winding cores 33 and the spacers 34 toward the fixed collar 31, each of the winding cores 33 can be rotated independently.

As a result, when the peripheral velocity W1 of the web coil 25*a* (see FIG. 3) having the larger winding diameter decreases, the spacer body 57 of the spacer 24 is rotated at the same speed as the first winding shaft 26, and the contact member 58 abutting on the winding core 33 is rotated relative to the spacer body 57. Therefore, the torque caused by the rotation of the spacer body 57 does not prevent decelerating of the web coil 25*a*.

Further, even when the biasing force by the biasing mechanism 35 is strong, each contact member 58 formed on both side surfaces of the spacer body 57 rotates relative to the spacer body 57. Therefore, each of the winding cores 33 rotates independently, and the web coils 25 having a winding diameter different from each other don't rotate at the same rotational speed.

As described above, since the spacer 34 has a so-called thrust bearing shape in this embodiment, it is possible to prevent transmission of the torque between the winding core 33 and the spacer 34. Therefore, it is possible to rotate each of the winding cores 33 independently, and stabilize the winding tension on the product webs 11*a* around the winding cores 33.

Next, an operation of this embodiment is described. Before starting driving of the web cutting device 10, the raw material web coil 17 is set to the coil rotational shaft 18 of the raw material web supplying device 13. Further, the winding cores 33 and spacers 34 are mounted alternately to the first and second shafts 26, 27 of the web winding device 15, respectively. Next, the biasing mechanism 35 biases the winding core 33 and the spacers 34 toward the fixed collar 31. Upon finishing the preliminary works described above, an operator starts driving of the web cutting device 10 and drives the air blower 41 to pressurize the chuck claw 43 against the inner peripheral surface of the winding core 33 (see FIG. 2). Upon starting of the driving of the web cutting device 10, a coil rotational shaft 18 is rotated clockwise in the drawing. Then, the raw material web 11 is drawn from the raw material web coil 17, and transported to the slitter 14 by the suction drum 20.

Rotatable cutting blades 21 and 22 start rotating respectively before the raw material web 18 transported from the raw material web coil 17 reaches between the rotatable cutting blades 21 and 22 of the slitter 14. Thereby, the raw material film 11 is cut into the plurality of product webs 11*a*. Further, the product webs 11*a* thus cut are allocated in an alternate manner, one by one, to the first winding shaft 26 and the second winding shaft 27 of the web winding device 15.

The front ends of the product webs 11*a* allocated to the first and second winding shafts 26 and 27 respectively are wound around the winding cores 33 by the web winding device not shown in the drawing. Next, upon starting the rotation of the motor 37, both winding shafts 26 and 27 are rotated. Upon rotation of both winding shafts 26 and 27, the pressing surface 42 of each chuck claw 43 and the inner peripheral surface of the winding core 33 are in sliding contact with each other, and thereby the rotational force of the shafts are transmitted to the winding core 33. Both winding shafts 26 and 27 are rotated faster than the winding core 33 rotating at the peripheral velocity corresponding to the transporting speed of the product web 11*a*. Due to the rotational difference, the winding tension on the product web 11*a* wound around the winding core 33 is generated.

In this embodiment, the spacer 34 is divided into three sections including the spacer body 57 being in contact with the peripheral surface of the winding shaft 26 or 27, and the contact members 58 being in contact with the winding cores 33 on both sides of the spacer body 57. The spacer body 57 holds the contact member 58 such that the contact members 58 rotate relative to the spacer body 57. Accordingly, it is possible to prevent the transmission of torque between the winding core 33 and the spacer 34 almost completely, and rotate each winding core 33 (web coil 25) independently.

Consequently, when the peripheral velocity W1 of the web coil 25*a* (see FIG. 3) having the larger diameter due to the thickness variation of the product web 11*a* is decreased, the contact member 58 abutting on the winding core 33 rotates relative to the spacer body 57. Thereby, the spacer 34 does not prevent decelerating of the web coil 25*a*. Additionally, in a case where the biasing force by the biasing mechanism 35 is strong, the web coils 25 having a winding diameter different from each other don't rotate at the same rotational speed. As a result, since the winding tension on the product web 11*a* being wound around the winding core 33 is stabilized, the winding shape and winding hardness of the product web coil 25 can be stabilized.

Upon finishing winding of the product web coil 25, the rotation of the motor 37 is stopped, and the supplying of high-pressure air from the air blower 41 is also stopped, thus interrupting the pressure contact between the chuck claw 43 and the winding core 33. Next, the web cutting device not shown in the drawing cuts a predetermined position of each of the product webs 11*a*. Upon finishing cutting of the product web 11*a*, the operator removes the web coils 25 together with the winding cores 33 from the winding shafts 26, 27, and mounts new winding cores 33 and the spacers 34 to the winding shafts 26, 27 in an alternate manner. Then, the peripheral surface of the new winding core 33 is pressed by the chuck claw 43, and the front end of the product web 11*a* is wound around the core by the web winding device not shown in the drawing. Hereinafter, the product web coil 25 is wound in the same manner.

Note that, in this embodiment, in order to prevent the transmission of torque between the winding core 33 and the spacer 34, the spacer body 57 holds the approximately annular contact member 58 such that the contact member 58 rotates relative to the spacer body 57. However, the present invention is not limited thereto. Any member can be adopted as long as the member abuts on the side surface of the winding core 33 and be held rotatably by the spacer body 57 in accordance with the rotation of the winding core 33. For example, instead of the contact member 58, the approximately cylindrical or spherical resin roller 70 may be used. Hereinafter, by referring to FIGS. 6 and 7, a spacer 71 including the resin roller 70 according to another embodiment of the present invention is described. Here, the components having the same function as those of the spacer 34 are denoted by the same reference numerals, and the description thereof will be omitted.

Figure 6:
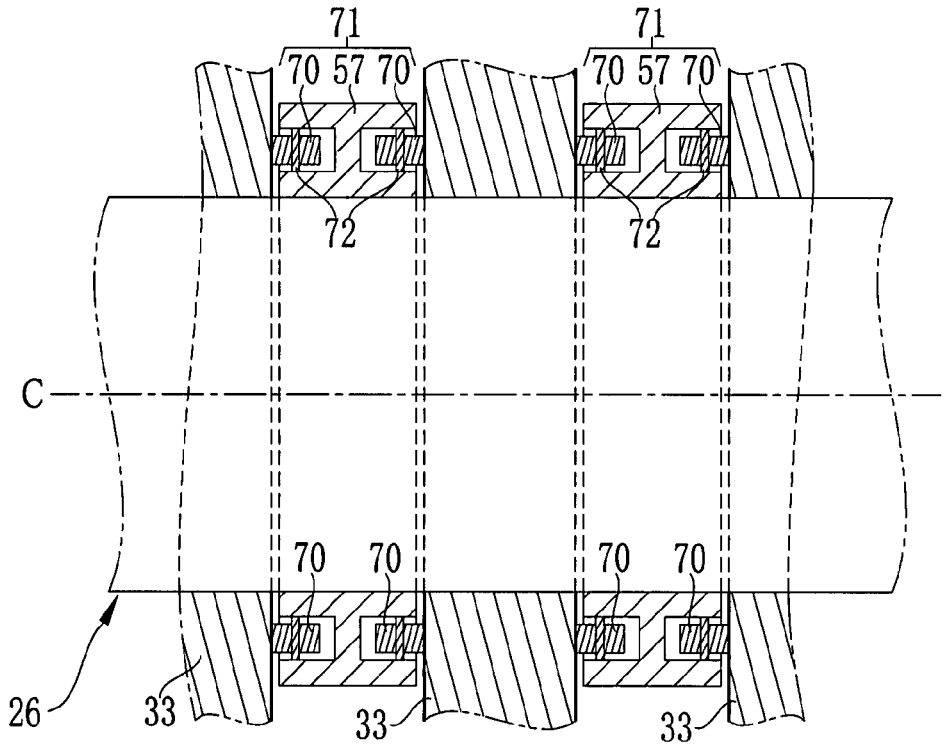
[FIG. 6] A sectional view of spacers according to another embodiment of the present invention.
Figure 7:
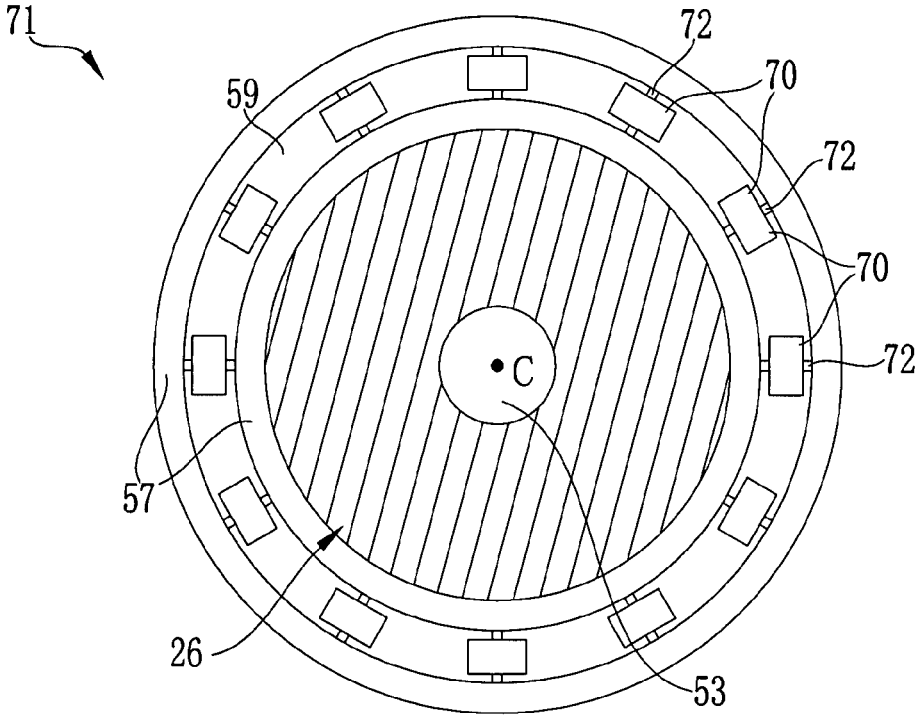
[FIG. 7] A front view of the spacer according to another embodiment of the present invention viewed in the axial direction of the winding shaft.

As shown in FIG. 6 and FIG. 7, the plurality of resin rollers 70 are disposed at the same interval in the contact member holding recess 59 so as to enclose the winding shafts 26, 27. Each resin roller 70 is held by the rotational shaft 72 provided in the contact member holding recess 59 such that it can rotate around the axis parallel to a radial direction of the winding shafts 26, 27. Therefore, even when one of the spacer body 57 and the winding core 33 is rotated, each of the resin rollers 70 is rotated solely, and slight torque is applied to the remaining one. Consequently, it is possible to prevent the transmission of torque from the spacer 71 to the winding core 33 almost completely as in the case using the contact member 58, and therefore it is possible to rotate each web coil 25 and the winding core 33 independently from each other.

Further, although the raw material web 11 is cut by the slitter 14 into eight sheets of the product web 11*a*, and four winding cores 33 are mounted on the first and second shafts 26, 27 respectively in this embodiment, the present invention is not limited thereto. The number of sheets of the product web 11*a* and the number of the winding cores 33 and the spacers 34 to be mounted can be varied as needed.

Note that, although the product webs 11*a* obtained by being cut by the slitter 14 are allocated one by one to the two winding shafts 26, 27 in an alternate manner in this embodiment, the present invention is not limited thereto. The number of winding shafts may be three or more, and the product webs 11*a* are allocated to the respective winding shafts.

[Experiment]

In order to provide evidence to prove the effect of the present invention, in both "Comparative Example" in which a conventional spacer was mounted to the first winding shaft 26 and "Example" in which the spacer 34 of the present invention was mounted to the first winding shaft 26, the product web 11*a* was wound around the plurality of winding cores 33 disposed in the axial direction of the winding shafts, and the winding tension was measured and the measurement results were compared.

The kind of the product web 11*a* (the raw material web 11), the set value of air pressure of the air blower 41, the rotational speed of the motor 37, the winding cores 33 at which winding tension is measured, a tension measuring device were common between "Comparative Example" and "Example". Only the spacer to be used was different therebetween. Further, when measuring the winding tension at each winding core 33, winding tension was measured at plural points in the axial direction of the winding shaft, and average value (AVE), maximum value (MAX), and minimum value (MIN) of the winding tension was obtained at each winding core 33. Further, for comparison, a certain reference value (not shown publicly) of the winding tension, which was common between "Comparative Example" and "Example", was designated by the inventor of the present invention and considered as 100%, and then the measurement result of the winding tension at each winding core 33 is shown relative to the reference value in a graph. The measurement result of "Comparative Example" is shown in a graph of FIG. 8, and the measurement result of "Example" is shown in a graph of FIG. 9.

Figure 8:
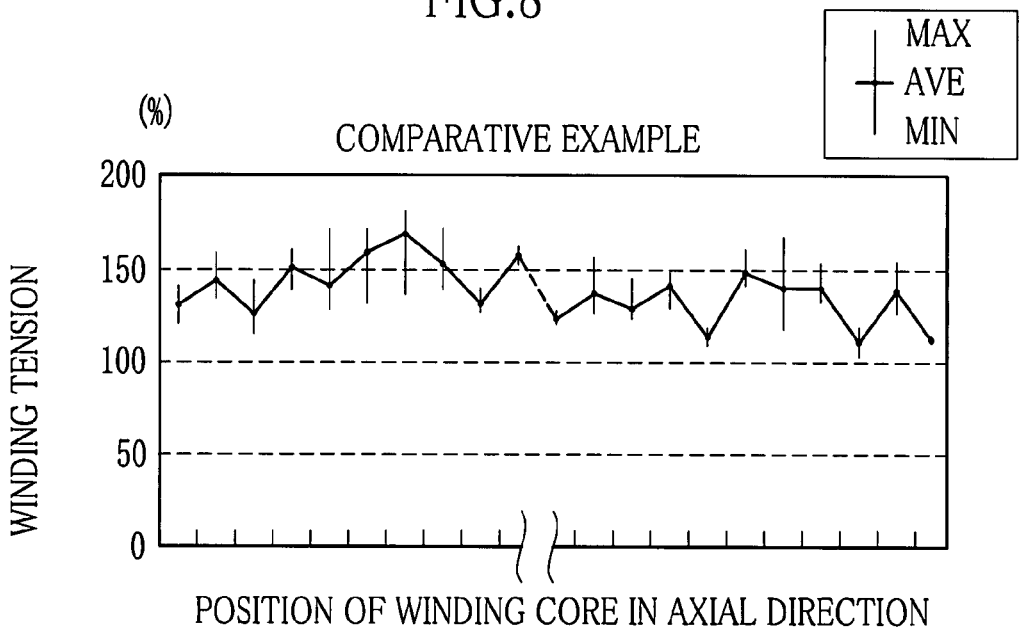
[FIG. 8] A graph showing a measurement result of winding tension on each winding core relative to one standard winding core in Comparative Examples.
Figure 9:
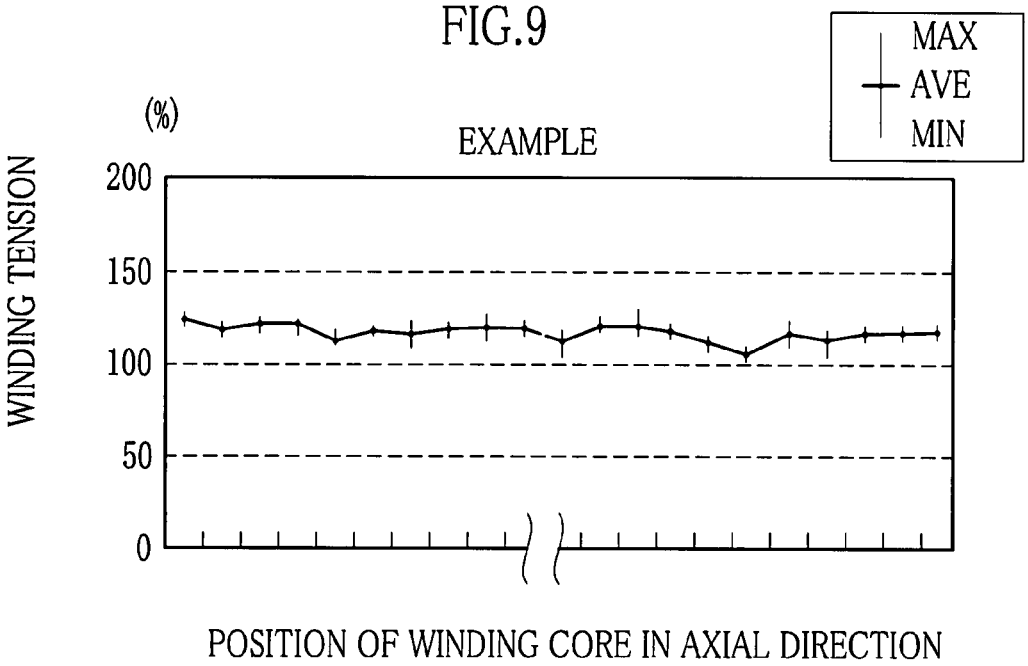
[FIG. 9] A graph showing a measurement result of winding tension on each winding core relative to one standard winding core in Examples.

As shown in FIG. 8 and FIG. 9, the winding tension was varied among the winding cores 33 in "Comparative Examples". On the contrary, it was confirmed that the winding tension was almost constant among the winding cores 33 in "Example". That is, it was confirmed that the transmission of toque between the winding core 33 and the spacer 34 was prevented and each web coil 25 and each winding core 33 were independently rotated since the spacer 34 is divided into three sections including the spacer body 57 being in contact with the peripheral surface of the winding shaft 26 or 27 and the contact members 58 abutting on the winding cores 33 adjacent to the spacer body 57, and further the spacer body 57 held the contact member 58 such that the contact member 58 rotated relative to the spacer body 57. Moreover, it was confirmed that it was possible to stabilize the winding tension on the product web 11*a* wound around the winding core 33 in the above structure.

INDUSTRIAL APPLICABILITY

The present invention is applicable to various kinds of web winding devices capable of simultaneously winding various kinds of narrow webs such as a protective film for liquid crystal display, PET (Polyethylene Terephthalate) film, magnetic recording tape, photo film, adhesive agent tape, or the like.

The invention claimed is:

1. A web winding device for simultaneously winding a plurality of webs around a plurality of winding cores each corresponding to said webs, comprising:

one or more winding shafts extending along a width direction of said web and having said winding cores arranged in a line thereon along an axial direction thereof, said winding core being rotatable around said winding shaft;

a rotation transmission member provided at said winding shaft and being in sliding contact with an inner peripheral surface of each of said winding cores at the time of rotating said winding shaft; and a plurality of spacers mounted to said winding shaft alternately with said winding cores, for positioning said winding cores in said axial direction, wherein said spacer comprising:

(a) an approximately cylindrical spacer body abutting on said winding shaft;

(b) a contact member protruding from a side surface of said spacer body opposed to said winding core and abutting on said winding core; and (c) a holding member provided in said spacer body, for holding said contact member rotatably around said spacer body.

2. A web winding device as defined in claim 1, wherein said contact member has an annular shape with its center at a rotational axis line of said winding shaft, and is held by said holding member so as to be rotatable around said rotational axis line relative to said spacer body.

3. A web winding device as defined in claim 2, wherein said contact member includes an approximately annular holding recess formed on a side surface of said spacer body opposed to said winding core and centered around said rotational axis line, and a plurality of rollers disposed between a bottom surface of said holding recess and said contact member.

4. A web winding device as defined in claim 3, wherein said spacer body, said contact member, and said rollers are made from any of one of resin, MC material, and MC nylon material.

5. A web winding device as defined in claim 1, wherein said contact member is a plurality of rollers, and said rollers are arranged in an annular shape centered around a rotational axis line of said winding shaft and held by said holding member so as to be rotatable around an axis parallel to a radial direction of said winding shaft.

6. A web winding device as defined in claim 1, further comprising a plurality of said winding shafts, and wherein said webs are allocated to each of said winding shafts and wound around said winding cores mounted to each of said winding shafts.

7. A spacer mounted to a winding shaft alternately with each of a plurality of winding cores, for positioning said winding core in an axial direction of said winding shaft, comprising:

an approximately cylindrical spacer body abutting on said winding shaft;

a contact member protruding from a side surface of said spacer body opposed to said winding core and abutting on said winding core, said contact member having an approximately annular shape with its center at a rotational axis line of said winding shaft;

an annular holding recess formed on a side surface of said spacer body opposed to said winding core centered around said rotational axis line, for holding said contact member rotatably around said rotational axis line of said winding shaft; and a plurality of rollers disposed between a bottom surface of said holding recess and said contact member.

8. A spacer as defined in claim 7, wherein said spacer body, said contact member, and said rollers are made from any of one of resin, MC material, and MC nylon material.

* * * * *